United States Patent [19]

Rose

[11] Patent Number: 4,934,066

[45] Date of Patent: Jun. 19, 1990

[54] GOLF CLUB HANDLE DRYING DEVICE

[75] Inventor: Charles F. Rose, Greenville, N.C.

[73] Assignee: Grip Dri Corporation, Palmyra, N.C.

[21] Appl. No.: 280,161

[22] Filed: Dec. 5, 1988

[51] Int. Cl.[5] ..... F26B 3/00

[52] U.S. Cl. ..... 34/9; 34/21; 34/107; 34/95; 15/104.92

[58] Field of Search ..... 34/95, 9, 21, 107, 104, 34/202; 15/104.92; 273/75

[56] References Cited

U.S. PATENT DOCUMENTS

| | | | |
|---|---|---|---|
| 3,224,029 | 12/1965 | Domingos | 15/104.92 |
| 3,583,018 | 6/1971 | Fink | 15/104.92 |
| 4,012,845 | 3/1977 | Judge et al. | 34/95 X |
| 4,570,358 | 2/1986 | Sacerdote | 34/107 X |

*Primary Examiner*—Henry A. Bennet

*Attorney, Agent, or Firm*—Olive & Olive

[57] ABSTRACT

A golf club handle drying device comprising a tubular piece that is closed at a first end and open at a second end, a cap, a desiccant, and means for removing desiccant from the golf club handle. A wet golf handle is dried by placing it in the tubular piece in contact with the desiccant.

8 Claims, 3 Drawing Sheets

GOLF CLUB HANDLE DRYING DEVICE

BACKGROUND OF THE INVENTION

1. Field of the Invention

This invention relates to a device for drying the handle of a golf club.

2. Description of the Related Art

One of the problems encountered by golfers is maintaining a good grip on a golf club in wet weather. Although golfing in the rain may be made relatively comfortable if the golfer is protected by water repellent clothing, the golf club itself, including the handle, generally becomes wet in the rain. This causes problems with the golfer's swing and ability to hold the club securely.

A standard method for overcoming the problem of keeping a golf club handle dry is for the golfer to use a towel or other cloth to dry the golf club handle This is only a temporary solution because after multiple uses, the towel itself becomes wet and no longer is useful in drying the club handle.

Covers for golf club handles have been devised to protect the handle when the golf club is not in use and to dry a handle not in use, such as the cover of Proutt (U.S. Pat. No. 4,662,415). Proutt's cover comprises a water resistant outer layer, an inner layer of fibrous resilient material of towelling or non-woven cotton int type material, and a means for closely surrounding the shaft. Like a towel, the fibrous liner loses its ability to absorb water after numerous replacements of the handle within the cover.

Another device intended to keep the handle of a golf club dry consists of a dry-grip sleeve (U.S. Pat. No. 3,397,891). Such a sleeve is made of waterproof material and is designed to receive a golf club shaft and one or both hands of a golfer that are gripping the shaft. These sleeves must be opened and closed to change golf clubs or when the golfer wishes to alter which hand(s) are in the sleeve. Opening and closing the sleeve also provide opportunities for rain to enter the sleeve. Once wet golf clubs or wet hands are placed in the sleeve, the sleeve does not provide a way of drying the club handle and the golfer is again gripping a wet golf club handle. Such a sleeve may also interfere with a golfer's concentration by its restrictive placement around the golfer's hand(s) and golf club handle.

Accordingly, it is an object of the present invention to provide a device for drying the handle of a golf club.

It is a further object of the invention to provide a golf club handle drying device that retains its drying capacity after multiple uses.

It is a further object of the invention to provide a golf club handle drying device that does not interfere with the golfer's concentration.

Other objects and advantages will be more fully apparent from the following disclosure and appended claims.

SUMMARY OF THE INVENTION

The invention provides a device with a tubular body having a closed bottom end and an openable top end. The device contains a quantity of desiccant material. The top end of the tubular body has a circular opening surrounded by a circular brush cylinder in which the brush bristles preferably are directed inward. A cap is provided to close the end of the tubular body when the tubular body is not in use.

When the golf club handle drying device is used, the handle-grip portion of the golf club is inserted into the tubular body through the open top end and contacted with the desiccant to enable drying of the handle. When the handle is removed from the tubular body, the brush bristles remove most be removed with a towel.

Other aspects and features of the invention will be more fully apparent from the following disclosure and appended claims.

DETAILED DESCRIPTION OF THE INVENTION AND PREFERRED EMBODIMENTS THEREOF

Figure 1:
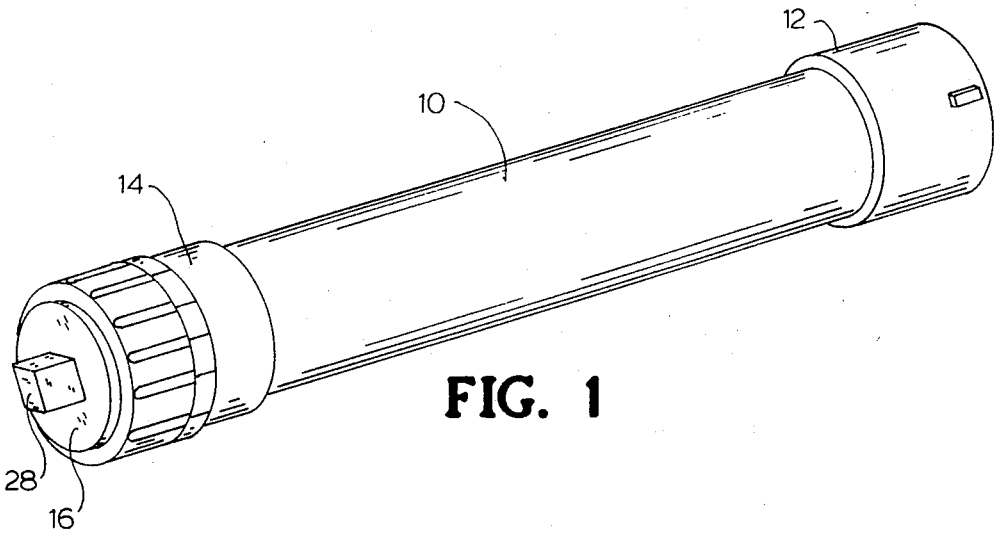
FIG. 1 is a perspective view of the golf club handle drying device of the invention.

The present invention is shown in its preferred embodiment in FIGS. 1–9. In its preferred embodiment the golf club handle drying device comprises a cylindrical tubular piece 10, a closed end piece 12, a partially interiorly threaded open end piece 14, a cap 16 having exterior threading, a narrow cylinder of bristles 18 near to and inside the open end of the tubular piece 10, and a desiccant material 20.

Figure 2:
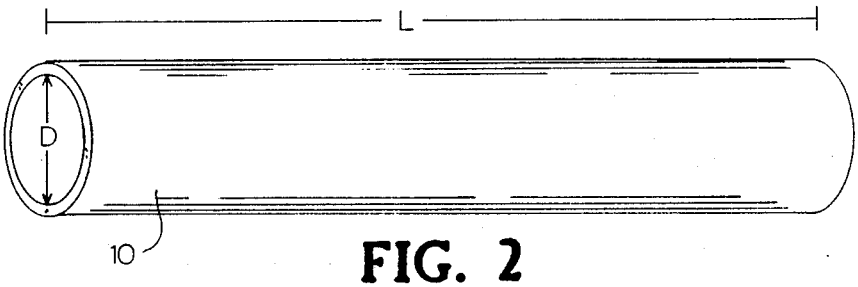
FIG. 2 is a side elevational view of the tubular piece of the invention.
Figure 3:
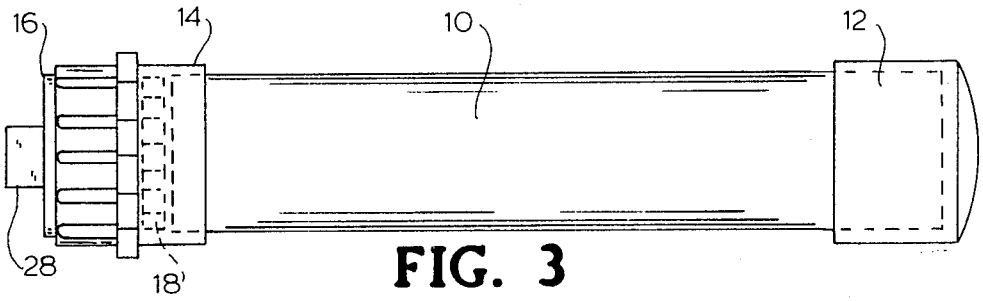
FIG. 3 is a side elevational view of the tubular piece, desiccant area, brush area, threaded end and cap of the invention.

The cylindrical tubular piece 10 shown in FIG. 2 is of a size to hold the handle of a golf club, preferably about eleven inches in length L and about $2\frac{1}{4}$ inches in internal cross-sectional diameter D. The tube should be of an internal diameter and length to accommodate a golf club handle. The tubular piece 10 is preferably made of PVC tubing having a wall thickness of about $\frac{1}{8}$ inch. The tubular piece 10 may also be made of sheet metal or plastic or other materials that are light-weight, shatter-resistant, sturdy, and waterproof In the preferred embodiment, a closed end piece 12 is attached to one end of the tubular piece 10. The end piece 12 comprises another piece of PVC tubing (schedule 40 PVC plumbing pipe) having a tubular portion with an internal diameter sufficient to fit over the outside of the tube 1 ($2\frac{3}{8}$ inches) (FIG. 3).

Figure 4:
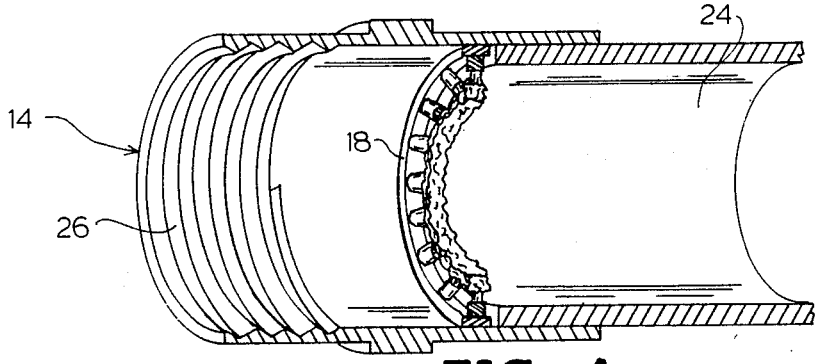
FIG. 4 is a partial sectional side view of interior threads of the open end piece of a preferred embodiment of the invention.

The open end piece 14 is also preferably PVC tubing (such as a "clean-out" PVC plumbing pipe piece) having an internal diameter of $2\frac{3}{8}$ inches. One end of the open end piece 14 has a smooth interior 24 while the other end has interior threads 26 as shown in FIG. 4.

Figure 5:
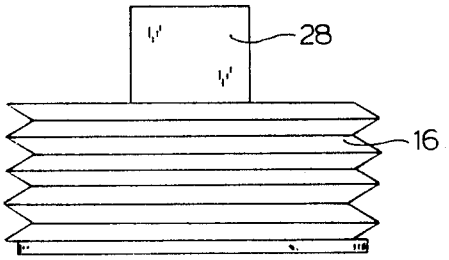
FIG. 5 is an elevational view of a preferred embodiment of the cap of the device of the invention.
Figure 6:
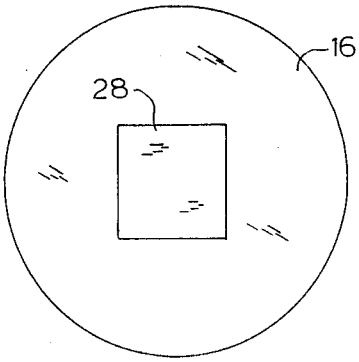
FIG. 6 is a cross sectional view of a preferred embodiment of the cap of the device of the invention.
Figure 7:
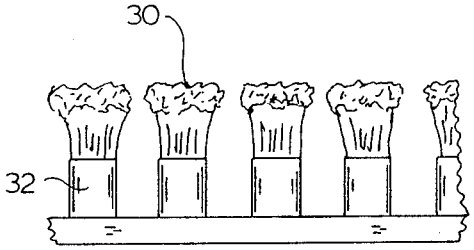
FIG. 7 is an elevational view of a section of preferred brush bristle material used in the invention.

The smooth end of the open end piece 14 is attached to the outside of the end of the tubular piece 10 opposite the closed end piece 12. The threaded end 26 of the open end piece 14 extends beyond the end of the tubular piece 10 for about 1¼ inches so that a threaded cap 16 may be screwed into the open end piece 14 to close the tubular piece 10. The external diameter of the threaded area of the cap is preferably 2-5/16 inches to fit within the threaded interior of the open end piece 14. The threaded cap 16 preferably has a handle piece 28 such as the cube-shaped piece shown in FIG. 5 to assist in opening and closing the tube by removal of the cap 16 (FIGS. 5–6). A handle piece with a height of ¾ inch and a length and width each of about one inch has been found to work well in the invention. The cap 16 is made of PVC, such as a PVC "clean out plug" plumbing pipe piece, in the preferred embodiment. The device of the invention, preferably made of the tubular piece 10, end pieces 12, 14 and the cap 16 may also be constructed or molded as one tubular piece that is closed at one end and closable with a cap piece at the other end but the resulting device may be less sturdy and more expensive than the multi-component PVC device. The cap 16 may comprise a cork or stopper instead of a threaded piece or may be otherwise configured as caps known in the art so that it keeps water out of the tube and the desiccant remains in the tube. In this case the interior of the open end 14 does not need to be threaded. The cap 16 may be attached to the tube 10 by a linear piece of plastic, chain or other material (not shown) so that the cap 16 does not fall or become lost when it is removed from the open end 14.

Figure 8:
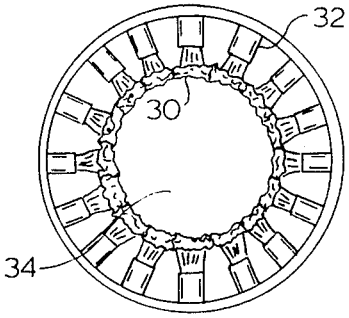
FIG. 8 is a top elevational view of the circular ring of bristles used in the invention.
Figure 9:
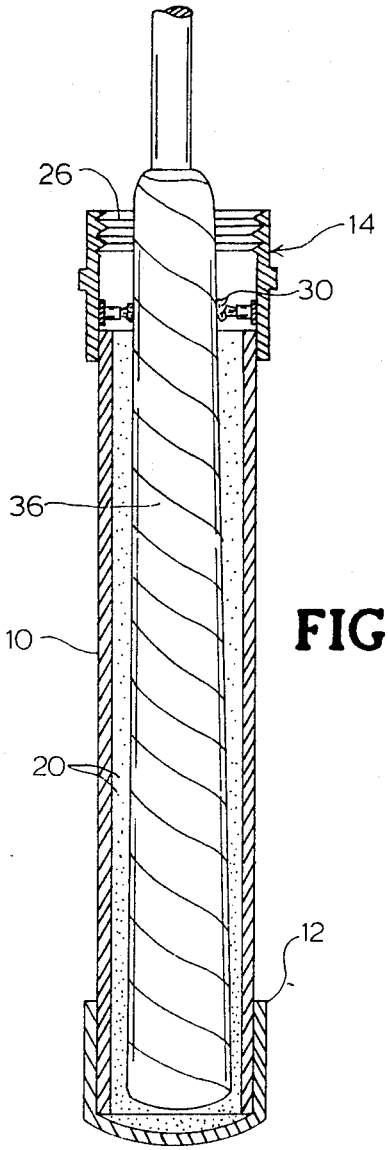
FIG. 9 is a perspective view of the device of the invention as used to dry a golf club handle with part of the device cut away to show the golf club inserted within the device.

A row of bristles 18 is placed inside the open end piece 14 in the smooth interior 24 next to the threaded area 26. Bristled strips (FIG. 7) may be cut from brushes obtained commercially from Empire Brushes, Inc. (Greenville, NC), for example, and may be made of any brush material such as camel hair or polypropylene. The latter bristles hold their shape better after repeated wetting and stay cleaner than animal hairs. These strips are formed into a cylinder with the bristled side 30 toward the cylinder center and the rubberized portion 32 attached to the inside of the open end piece 14 as shown in FIG. 8. The opening 34 in the bristles should be of a size to permit entry of the golf club handle 36 with the bristles 30 brushing the handle surface as it is inserted into the tube as shown in FIG. 9 and when it is removed. Other encircling structural brush-like materials may be used instead of the bristles of the preferred embodiment.

After assembly of the device, approximately 3 oz. of desiccant material 20 (FIG. 9) is added to the tube by pouring it in the open end of the tube. Desiccant material 20 may comprise silica gel or resins such as are used by pitchers to dry their hands. Such resins are less preferred than silica gel because they tend to make the golf club handle slippery. Even after extensive and repeated use, silica gel retains its drying capacity. Drying capacity can be increased between uses by shaking the closed tube.

Generally, the device is used by:

(a) placing the handle of a golf club within the tubular piece of the device;
(b) contacting the handle with a desiccant;
(c) removing the handle from the tubular piece; and
(d) removing adherent desiccant from the handle.

In particular the device of the invention is typically used in the following manner by:

(a) orienting the tubular piece substantially vertically with the cap uppermost;
(b) removing the cap from the tube;
(c) inserting a wet golf club handle in the open end of the tube until the handle hits the bottom of the tube;
(d) blocking the opening of the tube around the handle;
(e) tilting the tube to allow desiccant powder to flow over the handle;
(f) shaking the tube in a substantially vertical position;
(g) withdrawing the handle from the tube past the brush; and
(h) removing the remaining adherent desiccant from the handle.

The means of accomplishing steps (d) and (i) may utilize a towel or other material(s). Thus, a towel may be placed about the golf club handle portion at the upper end of the tube in step (d) to keep desiccant from escaping during the tilting and shaking of the tube (steps (c) and (g)). A dry towel may also be used to remove remaining desiccant in step (i). This is an improvement over use of a towel as the sole means of drying the handle because in the device and method of the invention the towel is not used to dry the handle and thus, does not become wet with continued use. Positioning the tube substantially vertically during the shaking process minimizes the possibility of inadvertent loss of desiccant from the open end of the device.

While the invention has been described with reference to specific embodiments thereof, it will be appreciated that numerous variations, modifications and embodiments are possible, and accordingly, all such variations, modifications, and embodiments are to be regarded as being within the scope of the invention.

What is claimed is:

1. A golf club handle drying device, comprising:

(a) a tubular piece, said tubular piece having a first closed end and a second open end, said tubular piece having internal dimensions sufficient to contain a golf club handle;
(b) a cap, said second open end closable by said cap;
(c) a desiccant material located within the tubular piece; and
(d) a means for removing the desiccant from the handle, said means located within the tubular piece.

2. A golf club handle drying device according to claim 1, wherein the means for removing the desiccant from the handle comprises a cylinder of inwardly extending bristles, said cylinder being within the tubular piece near said second open end.

3. A golf club handle drying device according to claim 1, wherein the desiccant comprises silica gel.

4. A golf club handle drying device according to claim 1, wherein said tubular piece comprises a piece of polyvinyl chloride pipe, said first closed end comprises a closed segment of polyvinyl chloride pipe, said second open end comprises a tubular piece of polyvinyl chloride pipe having interior threads at one end, and said cap comprises an exteriorly threaded piece of polyvinyl chloride; said exteriorly threaded piece being screwable into said interior threads.

5. A golf club handle drying device according to claim 1, wherein the second open end is interiorly threaded and the cap is exteriorly threaded to fit within the second open end.

6. A golf club handle drying device according to claim 1, wherein the second open end is interiorly threaded and the cap is exteriorly threaded to fit within the second open end; said desiccant comprises silica gel; and the means for removinq the desiccant from the handle comprises a cylinder of inwardly extending bristles, said cylinder being within the tubular piece near said second open end.

7. A golf club handle drying device according to claim 6, wherein said tubular piece comprises a piece of polyvinyl chloride pipe, said first closed end comprises a closed segment of polyvinyl chloride pipe, said second open end comprises a tubular piece of polyvinyl chloride pipe having interior threads at one end, and said cap comprises an exteriorly threaded piece of polyvinyl chloride; said exteriorly threaded piece being screwable into said interior threads.

8. A means for drying a golf club handle, comprising:

(a) placing the handle within a tubular device containing a desiccant;

(b) contacting the handle with the desiccant, said contacting comprising:

(i) blocking the opening of the tube around the handle;

(ii) tilting the tube to allow desiccant powder to flow over the handle; and (iii) shaking the tube in a substantially vertical position;

(c) removing the handle from the tubular device; and (d) removing desiccant from the handle.

* * * * *